US005740623A

United States Patent [19]

Juhan et al.

[11] Patent Number: 5,740,623

[45] Date of Patent: Apr. 21, 1998

[54] TUBULAR IDENTIFICATION WRISTBAND

[75] Inventors: Dodge Juhan, Ontario; Dean D. Peterson, Sylmar, both of Calif.

[73] Assignee: Precision Dynamics Corporation, San Fernando, Calif.

[21] Appl. No.: 787,757

[22] Filed: Jan. 28, 1997

Related U.S. Application Data

[60] Provisional application No. 60/011,924 Feb. 20, 1996.

[51] Int. Cl.[6] ..... G09F 3/08

[52] U.S. Cl. ..... 40/633; 40/661; 63/3; 63/DIG. 3

[58] Field of Search ..... 40/633, 660, 661, 40/665; 63/1.1, 14.1, 14.2, 3, DIG. 3

[56] References Cited

U.S. PATENT DOCUMENTS

| | | | |
|---|---|---|---|
| 3,800,450 | 4/1974 | Laugherty et al. | 40/633 |
| 4,768,688 | 9/1988 | Harrigan | 63/3 X |
| 5,323,554 | 6/1994 | MacDonald | 40/633 |
| 5,343,608 | 9/1994 | MacDonald | 40/633 |

*Primary Examiner*—Brian K. Green
*Attorney, Agent, or Firm*—Thomas P. Mahoney

[57] ABSTRACT

An identification wristband is fabricated from transparent synthetic plastic and has a flattened central area wherein the inner surfaces of the central area are relatively close to each other and opposite edges communicating with the central area, which are substantially semi-circular in cross section, provide a receptacle for an information card or tag inserted in the band and the flattened area of the band facilitates the viewing of the information on the card. A connector is provided which is of substantially elliptical configuration in cross section and includes an abutment intermediate its extremities. The opposite extremities of the connector are receivable in the opposite extremities of the band body and, when inserted in the band body, distend the extremities to correspond to the elliptical configuration of the connector, thus causing a frictional grip to be exerted upon the extremities of the band body. The abutment is engaged on its opposite sides by the respective extremities of the band body and the elliptical perimeter of the abutment constitutes a smooth continuum of the extremities of the band body.

8 Claims, 1 Drawing Sheet

TUBULAR IDENTIFICATION WRISTBAND

This application claims the benefit of U.S. Provisional application Ser. No. 60/011,924, filed Feb. 20, 1996.

This invention relates to identification wristbands of the type generally utilized for identifying patients in hospitals or participants in group social activities such as concerts or the like.

BACKGROUND OF THE INVENTION

Conventional identification wristbands are generally of substantially flat cross section and consist of one or more laminates of various types of material including vinyl plastic, synthetic papers and the like. Although every effort is made to provide wristbands which are sufficiently soft so that the opposite edges of the band do not irritate the skin of the wearer, the utilization of conventional wristbands in environments where the wristband is installed upon the wrist of a patient or a prisoner for an extended period of time, irritates the skin of the wearer of the band.

This is particularly true in circumstances where the skin of the individual wearing a conventional band tends to be more friable than other individuals, such as the skin of a person committed for a long period of time to a rest home or convalescent facility. It is well known to those skilled in the art that the skin of these individuals tends to be more subject to abrasion and contusion than the skin of more mobile healthy individuals. This is due, in part, to the fact that many of these individuals are not ambulatory and are relatively immobile in beds or wheelchairs.

Under such circumstances, the conventional identification wristband tends to be rubbed sharply against the skin of the immobile individual and to gradually abrade the skin, causing cuts or sores which are highly undesirable in the rest home or convalescent home environment.

Prior art U.S. Letters Patent Nos. 5,323,554 and 5,343,608 show a circular tube utilized as an identification wristband body including a cylindrical connector and complicated method of securement of the opposite extremities of the tubular body to each other. This construction provides only lineal contact with the skin of the wearer and there is a tendency for the cylindrical body of the band to roll thus causing friction with the skin of the wearer and the misplacement of the identification card or tag which is located within the body.

OBJECTS AND ADVANTAGES OF THE INVENTION

It is an object of our invention to provide an identification wristband suitable for prolonged installation upon the wrist of convalescent or rest home patients which will eliminate the abrasion commonly encountered by the use of conventional identification wristbands.

Another object of our invention is the provision of an identification wristband which includes an elongated transparent plastic body having a tubular cross section constituted by an intermediate flattened portion and opposite, semi-elliptical edges providing cushions at the opposite edges of the band which eliminate the cutting or abrasion of the skin and which also prevent the rolling or twisting of the band.

Another object of our invention is the provision of an identification wristband of the aforementioned character which includes the above-described body and a connector of the elliptical cross section which, when installed in the opposite extremities of the wristband, causes the distention thereof into said elliptical cross section to provide a significant friction grip upon the interior surfaces of said extremities and lock the wristband against displacement from the wrist of the wearer.

A further object of the invention is the provision of a connector of the aforementioned character which includes an intermediate abutment engagable by the sharp edges of the opposite extremities of the band when installed upon the connector thus providing a smooth continuum and isolating the skin of the wearer from contact by said sharp edges.

An additional object of the invention is the provision of an identification wristband which is non-circular in cross-section and may have an elliptical, ovoid or similar cross-section with radii at the intersecting planes to eliminate the possibility of irritation of the skin of the wearer.

A further object of the invention is the provision of a non-circular wristband wherein the connector conforms substantially to the cross-sectional configuration of the wristband when distended by said connector and is slightly larger in dimension than the interior dimension of the wristband to accomplish an interference fit when the opposite extremities of the wristband engage the corresponding extremities of the connector.

Other objects and advantages of the invention will be apparent from the following specification and the accompanying drawings.

DESCRIPTION OF PREFERRED EMBODIMENT OF THE INVENTION

Figures 1, 2, 3, 4, 5:
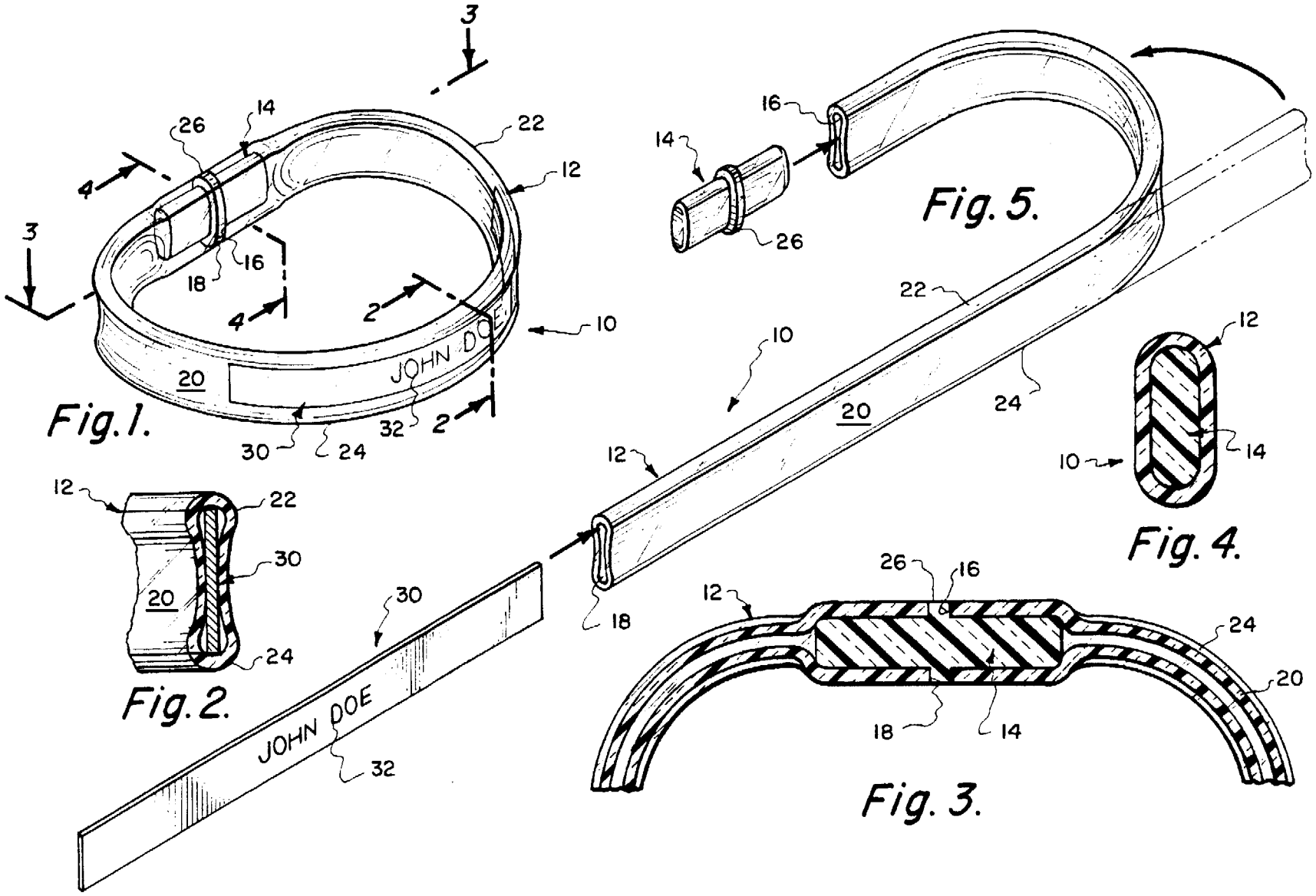
FIG. 1 is a view showing the identification wristband with its opposite extremities secured by the connector.
FIG. 2 is a vertical sectional view taken on the broken line 2—2 of FIG. 1.
FIG. 3 is a longitudinal sectional view taken on the broken line 3—3 of FIG. 1.
FIG. 4, is a transverse sectional view taken on the broken line 4—4 of FIG. 1.
FIG. 5 is an enlarged schematic view illustrating the relationship of the various components of the identification wristband with one another.

Referring to the drawing and, more particularly, to FIGS. 1 and 5, we show an identification wristband 10 which includes an elongated tubular body 12 fabricated from a synthetic plastic material such as polyvinyl chloride, which is transparent, and a connector 14 which may be fabricated from synthetic plastic such as general purpose polystyrene or the like. The elongated tubular body 12 has opposite extremities 16 and 18 which are relatively sharp and which could cause abrasion of the skin of a person upon whom the band 10 is installed for a long period of time.

The elongated tubular body 12 is fabricated by an extrusion process wherein the polyvinyl chloride or other material from which it is fabricated is extruded through a die which imparts the cross-sectional profile of said body to the polyvinyl material. After extrusion, the elongated resultant tubing is cut into desired lengths conformable to the broad spectrum of wrist or other sizes for which the body is to be utilized.

The tubular cross section of the body 12 is defined by an intermediate flat portion or area 20 which is located between the opposite semi-elliptical upper and lower edges 22 and 24 of the body 12. Therefore, the intermediate flat portion 20 of the body 12 imparts a relatively reduced cross section to the interior of the tubular body for purposes which will be described in greater detail below.

The connector 14 is of elliptical cross section and has, intermediate its extremities, an abutment 26 engagable by the corresponding extremities 16 and 18 of the tubular body 12. The abutment 26 is semi-elliptical in cross section and, when the opposite extremities of the connector 14 are inserted in the extremities 16 and 18 of the body, the sharp edges of said extremities engage the opposite sides of the abutment 26, and the outer rounded perimeter of the abutment isolates the sharp edges of the extremities 16 and 18 from engagement with the skin of a wearer of the identification wristband 10.

When the opposite elliptical extremities of the connector 14 are inserted in the flattened extremities 16 and 18 of the band body 12, said body extremities are distended from the flattened configuration of the body into a configuration corresponding to that of the extremities of the connector 14 resulting in an interference fit with said extremities of the band body and creating a frictional lock which cannot be easily released to permit the release of the identification wristband 10 from operative engagement with the wrist of a wearer.

An elongated information card 30 is provided for insertion into the cavity of the wristband body 12 and includes readable information 32 which can be perused by an interested party. Such information customarily incorporates the name of the wearer of the band and various other pertinent data relating to said wearer. In addition, bar codes and similar symbology can be placed on the surface of the information card 30 to facilitate access to further data regarding the wearer of the band.

As best shown in FIG. 2 of the drawings, the card 30, when inserted into the tubular cavity of the wristband 10, has its opposite surfaces closely juxtaposed to the inner surfaces of the flattened portions 20 of the wristband body 12. This close juxtaposition enhances the legibility of the informational material on the card 30 and also prevents the shifting of the card within the confines of the band 10.

To install the wristband 10 on the wrist of a wearer, it is simply necessary to cut the length of the band to fit the wrist of the wearer, cut the length of the information card as required, insert the information card 30 and engage the opposite extremities of the connector 14 into the wristband cavity. The opposite extremities of the connector 14 must be inserted with considerable force into the opposite extremities 16 and 18 of the wristband body 12 to distend the sharp edges of the extremities of the body 12 into intimate contact with the sides of the abutment 26 thus isolating said edges from contact with the skin of the wrist of the wearer of the band.

When so installed upon the wearer's wrist, gentle contact with the skin of the wearer is attained because of the cushion effect of the semi-elliptical upper and lower edges 22 and 24 of the band body. In addition, the planarity of the intermediate flat areas 20 of the band body 12 eliminates any tendency to pinch or roll upon the wearer's wrist and, thus, forestalls the formation of cuts or lesions which are inimical to the health of a confined person.

It is also contemplated that the cross-sectional configuration of the wristband be modified to include such cross-sections as elliptical or ovoid and that corresponding modifications of the shape of the connector be made so that the connector will fit into the opposite extremities of the wristband. For instance, an ovoid wristband will have an ovoid connector and an elliptical wristband will have an elliptical connector. Therefore, it is not intended that the cross-section of the wristband be limited to that of the preferred embodiment since many non-circular configurations can be substituted therefor.

We thus provide by our invention an identification wristband which can be worn for periods of indeterminate length without causing injury to the skin underlying the wristband. In addition, the non-corresponding configurations of the band body and connector provide for the distention of the extremities of the band when it is installed upon the connector thus creating a significant frictional lock upon the extremities of the band sufficient to prevent easy removal of the wristband from operative relationship with the wrist of the wearer.

Other objects and advantages of the invention will be apparent to those skilled in the art and it is not intended that the teachings of the invention be limited to the precise structure and configuration disclosed herein.

I claim:

1. In an identification wristband: an elongated tubular body formed from transparent synthetic plastic material and having first and second extremities, said tubular body having a substantially flat intermediate portion with top and bottom surfaces and semi-circular edges, said flat intermediate portion being adapted to receive an identification tag which can be effectively read through the substantially flat portion of said body and each of said semi-circular edges having a portion projecting above said top surface and a portion projection below said bottom surface of said flat intermediate portion; and a connector engagable with said first and second extremities for expanding said extremities into a substantially elliptical configuration and securing said first and second extremities against removal of said body.

2. The wristband of claim 1 wherein said connector is provided with an intermediate abutment having its opposite sides engagable by said first and second extremities of said tubular body.

3. The wristband of claim 2 in which said abutment is of elliptical cross-section and provides a continuum between the extremities of said body when said extremities are secured by said connector.

4. The wristband of claim 3 in which said abutment is of elliptical configuration to conform to the configuration of said extremities of said body as expanded by said connector.

5. In an identification wristband: an elongated transparent tubular body having first and second extremities for the reception of an informational tag or card, said tubular body having a flat intermediate card-receiving portion and semi-circular edges, said flat intermediate portion having top and bottom surfaces and each of said semi-circular edge having a portion projecting above said top surface and a portion projecting below said bottom surface of said flat intermediate portion; and a connector having opposite extremities receivable in said first and second extremities of said body to change the shape thereof, said connector having a centrally located perimetrical abutment engagable by the said opposite extremities of said body, said abutment having its perimeter flush with said extremities to provide a perimeter constituting a continuum of the opposite extremities of said body.

6. The wristband of claim 5 in which said body has a centrally-located flattened area and opposite edges of substantially elliptical cross section.

7. The wristband of claim 6 in which said abutment is of substantially semi-elliptical configuration.

8. The wristband of claim 6 in which a card is inserted between the interior surfaces of the flattened area of said wristband to facilitate the reading of the information contained upon a surface of said card.

* * * * *